US005878455A

United States Patent [19]

Patterson

[11] Patent Number: 5,878,455

[45] Date of Patent: Mar. 9, 1999

[54] CORNER GUARD FOR MATTRESS

[75] Inventor: Ken Patterson, Orange, Calif.

[73] Assignee: Chattam & Wells, Orange, Calif.

[21] Appl. No.: 9,793

[22] Filed: Jan. 21, 1998

[51] Int. Cl.[6] ..... A47C 31/00; A47C 21/00; A47C 23/00

[52] U.S. Cl. ..... 5/663; 5/254; 5/739; 248/345.1

[58] Field of Search ..... 5/663, 254, 739, 5/279.1, 246; 248/345.1; D6/606

[56] References Cited

U.S. PATENT DOCUMENTS

| | | | |
|---|---|---|---|
| D. 235,957 | 7/1975 | Mills . | |
| D. 384,537 | 10/1997 | Quintile | D6/606 |
| 2,951,253 | 9/1960 | Roche | 5/279 |
| 3,030,728 | 4/1962 | Wesman . | |
| 3,041,775 | 7/1962 | Brown, Jr. et al. . | |
| 3,406,411 | 10/1968 | Reis | 5/474 |
| 3,546,725 | 12/1970 | Tambascio | 5/200 |
| 3,710,405 | 1/1973 | Watts | 5/201 |
| 3,717,886 | 2/1973 | Watts | 5/239 |
| 3,725,188 | 4/1973 | Kalt . | |
| 3,738,259 | 6/1973 | Hochstatter | 53/124 R |
| 4,251,308 | 2/1981 | Miller | 5/400 |
| 4,740,034 | 4/1988 | Snyder et al. | 5/402 |
| 5,005,237 | 4/1991 | Luchonok | 24/72.5 |
| 5,265,291 | 11/1993 | Callaway | 5/254 |
| 5,628,080 | 5/1997 | Quintile | 5/663 |

FOREIGN PATENT DOCUMENTS

| | | | |
|---|---|---|---|
| 909976 | 11/1962 | United Kingdom | 5/663 |

*Primary Examiner*—Alex Grosz
*Attorney, Agent, or Firm*—I. Morley Drucker, Esq; Fulwider Patton Lee & Utecht, LLP

[57] ABSTRACT

A corner guard for reinforcing an edge or corner of a mattress of a bed is disclosed. The corner guard is constructed from a flat sheet of material formed into two flat panels intersecting to define a 90 degree primary angle, wherein the panels together further define interior areas facing the mattress and exterior areas facing away from the mattress. Each panel has a tab extending therefrom at right angles toward the interior. Each tab also has a fin extending therefrom toward the primary angle. Fastener openings are provided in each fin and tab. At the intersection of the base of each fin, tab, and panel is a circular cut-out. The corner guard can be punched and formed from metal or molded from polymer.

18 Claims, 1 Drawing Sheet

CORNER GUARD FOR MATTRESS

BACKGROUND OF THE INVENTION

1. Field Of The Invention

The present invention relates to a component for reinforcing a mattress. More precisely, the present invention relates to a corner guard with attachment tabs with adjustable fins.

2. Description Of Related Art

A certain component in reinforcing and protecting the edges and corners of a mattress for a bed is known as a corner guard. Typically, corner guards are attached to the lower, exterior rounded corners of a mattress or box spring. The corner guard protects the mattress and reinforces its form. Corner guards usually extend around the corner of the mattress with attachment means at the bottom of the corner guard.

Some examples of corner guards include U.S. Pat. Nos. 5,628,080 and Des. 384,537 to Quintile, which disclose a curve formed protective and decorative bedding foundation corner guard. The corner guard is mold formed in a curved configuration from a plastic material to include a curved wall with four securement tabs extending approximately 90 degrees from that wall.

U.S. Pat. No. 5,265,291 to Callaway discloses an improved box spring corner support that includes a corner guard that supports the upholstered fabric on a box spring. The corner guard is formed from a plastic and snap fits over the border wire to partially cover the corner of a typical wood slat base of a mattress.

U.S. Pat. No. 3,406,411 to Reis discloses a corner reinforcement for an upholstered article such as a box spring. The corner reinforcement is constructed from a self-supporting member extending around one corner of the frame of the box spring. The corner reinforcement further has flexible walls overlapping the frame adjacent the corner and extending vertically from a base surface of the frame to a point space above the frame.

U.S. Pat. No. 3,710,405 to Watts discloses a bedframe having corner members and rails, wherein the raised corner members prevent the box spring unit from slipping off the frame and protect the edge thereof. U.S. Pat. No. Des. 235,957 to Mills discloses a bedframe corner.

There are other innovations in protecting the components of a bed, including U.S. Pat. No. 3,546,725 to Tambascio, which discloses a bedframe with decorative trim strip. U.S. Pat. No. 2,951,252 to Roche discloses end caps used on a bedframe side rail. The end cap retains itself in engagement with the side rail by sliding thereon. The end caps prevent tears in the box spring or mattress, and minimizes snagging clothing or stockings of a person walking by the bedframe.

U.S. Pat. No. 5,005,237 to Luchonok discloses a mattress corner adhesion patch, which is a webbing made of a laminated, spun bound polyester encased in PVC. The patches are attached to the four corners of the water filled mattress to create friction between the bedding and the mattress. The friction thus prevents sliding of the bedding on the mattress.

U.S. Pat. No. 3,030,728 to Wesman discloses cushioning corner pieces fabricated by molding resilient rubber or plastic material. Each corner piece has spaced closed internal grooves that improve the cushioning function of the resilient material. The corner piece is placed on the sharp corners and edges of furniture for the protection of children and adults against injuries occasioned by accidental contact.

In view of the foregoing, however, there is still a need for a corner guard for a mattress that provides a superior mechanism for attaching the corner guard to the mattress.

SUMMARY OF THE INVENTION

The present invention is directed to a method and construction for a corner guard for reinforcing an edge or corner of a mattress. The corner guard is comprised of at least two panels intersecting to define a first angle, the panels together further defining interior areas facing the mattress and exterior areas facing away from the mattress. The corner guard further includes a tab extending from one panel to define a second angle, wherein the tab extends toward the interior areas. The tab also includes a fin extending therefrom toward a vertex of the first angle to form a gap along an edge of the fin and the associated panel. The fin and tab define a third angle.

Accordingly, the present invention provides an adjustable fin in addition to the tab that can be used to secure or attach the corner guard to a mattress. Importantly, the tabs of the present invention corner guard define a surface that can be attached to the mattress, while the fin associated with the tab provides another attachment surface that can be angled in another direction without distorting the surface of the tab.

The tab that extends from one panel thus provides one axis of freedom for adjustment of the tab when it is attached to the mattress. With the addition of a fin to that tab the attachment means of that panel now includes two axes of freedom, one defined by the bending of the tab and one defined by the bending of the fin. In the present invention, the mattress attachment area of one panel of the corner guard thus has at least two degrees of freedom, thereby minimizing the distortion and the chance of tearing of the tab from the panel. This also minimizes the chance of accidental separation of the corner guard from the mattress caused by detachment of the tabs due to its buckling or distortion imparted during assembly or use.

In addition, having the fins extending from the tabs places attachment points of the present invention corner guard very close to the primary angle defined by the two panels. This is important because high stresses are experienced at the primary angle. So using the fins as attachment points of the corner guard and locating them near the vertex of the primary angle help reinforce that high stress area.

From an engineering standpoint, the use of conventional tabs extending from the vertex or near the vertex of the primary angle proves to be complicated because of the bending involved in the area. For example, a tab extending at right angles from the primary angle when it is formed causes the tab to distort, buckle, or perhaps fold into a V-shape.

If the primary angle is formed with a large radius incorporated into the panels, a tab that extends at a right angle from the radiused edge of the panel experiences distortion. Due to the distortion problem, in some configurations it is not practical to locate securement tabs at or proximate to the vertex of the primary angle. On the other hand, the present invention overcomes this problem by using fins that extend toward the vertex of the primary angle. Because the fin is not directly connected to the curved, radius edge of the primary angle, the fin is not distorted. Because the fin is located proximate to the vertex of the primary angle, fasteners can be used to secure the corner of the mattress to the corner guard thus setting the distance therebetween. As a result, the corner of the mattress cannot pull away from the corner guard to leave an unsightly space. The present invention therefore improves fitment of the corner guard to the mattress.

It is therefore an object of the present invention to provide a corner guard that includes a tab and a fin extending therefrom to improve attachment of the corner guard to a mattress. It is another object of the present invention to provide a corner guard that allows the fin to flex somewhat independently from the tab thereby permitting fitment adjustments with at least two degrees of freedom. It is yet another object of the present invention to provide a corner guard that can secure the distance between the primary angle and the corner of the mattress. It is still another object of the present invention to provide a corner guard with slots and cut-outs to maximize adjustability of the fins for improved fitment and easier assembly to the mattress.

The present invention therefore has many advantages over the prior art. These advantages among others will become apparent from the following detailed description when taken in conjunction with the accompanying exemplary drawings.

DETAILED DESCRIPTION OF THE PREFERRED EMBODIMENTS

Figures 1, 2, 3, 4:
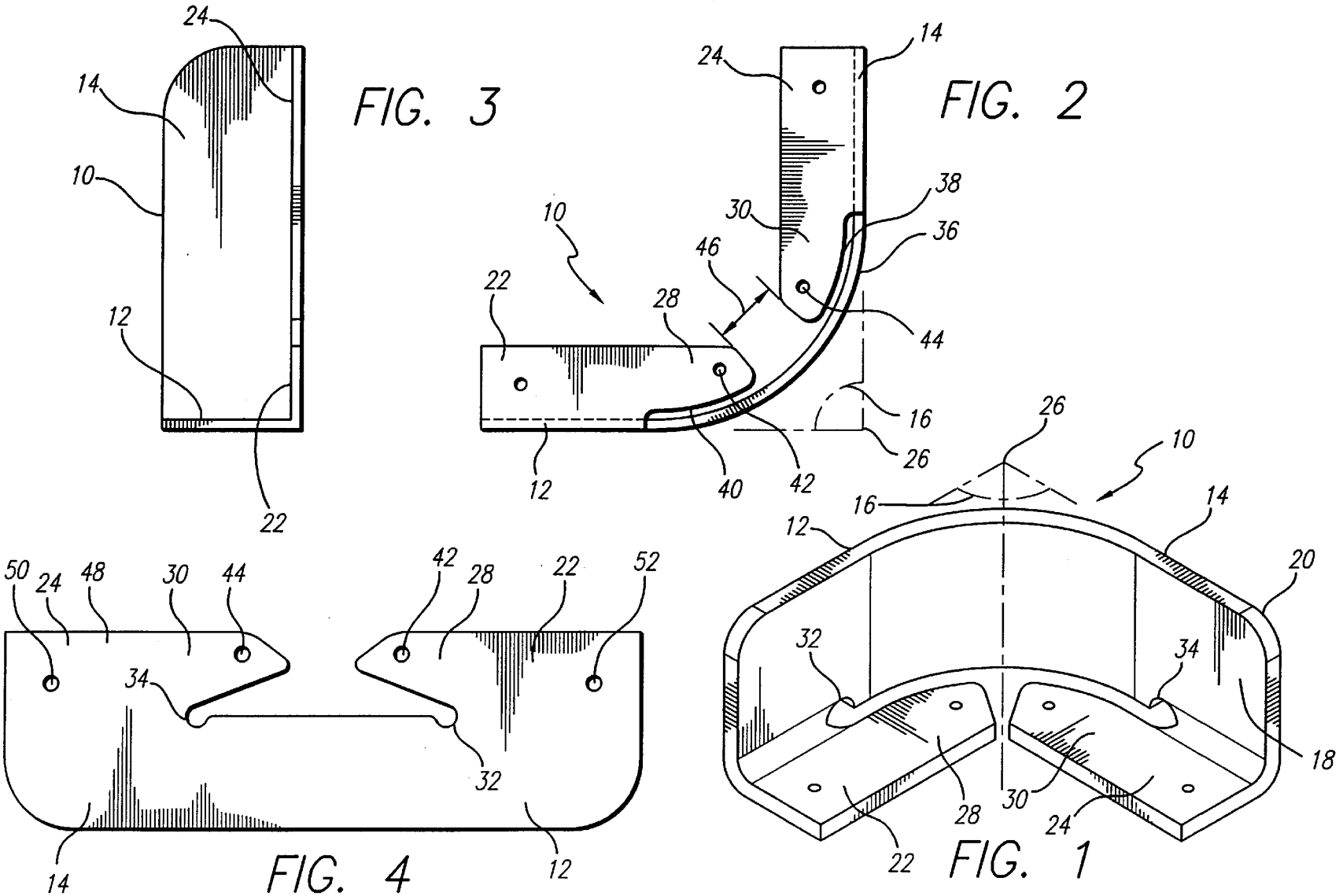
FIG. 1 is a perspective view of a preferred embodiment of the present invention corner guard showing two panels setting a primary angle of approximately 90 degrees, wherein each panel has a tab and a fin.
FIG. 2 is a top plan view of the preferred embodiment corner guard shown in FIG. 1.
FIG. 3 is a side elevational view of the preferred embodiment corner guard.
FIG. 4 is a plan view of a blank punched from flat sheet material prior to forming.

The following specification describes a corner guard used to protect the edge or corner of a mattress or like upholstered furniture. In the description, specific materials and configurations are set forth in order to provide a more complete understanding of the present invention. But it is understood by those skilled in the art that the present invention can be practiced without those specific details. In some instances, well-known features are not described precisely so as not to obscure the invention.

FIG. 1 provides a perspective view of a preferred embodiment of the present invention corner guard 10. In general, corner guard 10 is defined by at least two intersecting panels 12, 14. Each panel 12, 14 is generally planar and would intersect the other at primary angle 16 if extended. Panels 12, 14 form a wall dividing space into interior area 18 facing the mattress (not shown) and exterior area 20 facing away from the mattress.

The present invention corner guard 10, in fact, has a design that enables primary angle 16 to be adjustable from zero to approximately 135 degrees. Primary angle 16 is further flexible to a desired degree of curvature. In the exemplary embodiment shown, primary angle 16 is approximately 90 degrees to match the 90 degree corner of a mattress.

To secure corner guard 10 to the mattress, the preferred embodiment of the present invention preferably includes tabs 22, 24 extending toward interior area 18 and formed approximately at right angles to panels 12, 14, respectively. Each tab, 12, 24 has a generally flat plate configuration.

Preferably extending toward vertex 26 of primary angle 16 are fins 28, 30, located on tabs 22, 24. Each fin 28, 30 has a generally planar construction, but is independently movable relative to tabs 22, 24, such that movement of the former does not substantially distort or deform the latter. Accordingly, tabs 22, 24 have one degree of freedom each to move or be adjusted during attachment of corner guard 10 to the mattress. Fins 28, 30 add a second degree of freedom to the attachment points when corner guard 10 is attached to the mattress. Having at least the two degrees of freedom improves fitment of corner guard 10 and simplifies assembly in the production process.

Optional cut-outs 32, 34 are positioned at the intersection of tab 22, fin 28, and panel 12, and likewise at the intersection of tab 24, fin 30, and panel 14. Cut-outs 32, 34 provide not only a method of minimizing stress at the area where the three parts meet, but also provide yet another small degree of movement for fins 28, 30 so that they can be shifted laterally, as shown in FIG. 1, toward or away from their respective panels 12, 14. This can be accomplished by slight distortion of the material surrounding cut-out 32, 34.

As best seen in the plan view of FIG. 2, the present invention corner guard 10 has primary angle 16 that includes radius 36 imparted into panels 12, 14. The radius 36 substantially follows the rounded corner of a mattress. Furthermore, as best seen in FIG. 2, fins 28, 30 preferably include curved edges 38, 40 that somewhat follows the curvature of radius 36. Curved edges 38, 40 are spaced apart from radius 36 thereby setting a gap therebetween. This assures freedom of movement and adjustability of fins 28, 30.

With fins 28, 30 it is possible to locate fastener openings 42, 44 fairly close to primary angle 16. Therefore, the present invention corner guard 10 can be secured very close to the corner of the mattress where most of the stress and deformations occur. The present invention obviates the need to place securement tabs very close to or within the curved edge of radius 36, which curve causes a tab placed therein to distort or bend out of its planar shape.

Furthermore, without securement tabs extending from radius 36, its curvature can be adjusted easily. If securement tabs were present, they would likely break off when the curvature of radius 36 is adjusted. Without securement tabs at radius 36, the radius can be made with a thin walled material for flexibility.

Between fins 28, 30 is gap 46 that extends radially from vertex 26, thus further supplying space for adjusting the breadth of primary angles 16 without contact between fins 28, 30. Gap 46 also gives room for movement when fins 28, 30 are adjusted during installation to the mattress.

FIG. 3 is a side elevational view of a preferred embodiment corner guard 10. This view depicts the preferably planar or flat configuration of tabs 22, 24 and fins 28, 30 prior to deformation and adjustment during installation to the mattress. Of course, formations, contours, and shapes can be imparted into the base sheet material depending upon design needs and mattress construction.

The present invention corner guard 10 can be made from a variety of materials. For example, it can be made from brass that is polished and sealed. It can also be made from steel that may optionally be plated with nickel. The metallic material should be somewhat malleable and can be preferably punched from sheet stock.

FIG. 4 is an example of blank 48 that is punched from sheet stock, which is then formed into the present invention corner guard 10 through processes known in the sheet metal art. As seen in the top plan view of FIG. 4, the features of the present invention corner guard 10 can be punched in one operation without need of very detailed supporting processes which may increase costs. Other manufacturing processes, of course, are contemplated to obtain the present invention corner guard. In fact, fastener openings 42, 44, 50, 52, optional in number and location, can be obtained in one punching operation. The presence of cut-outs 32, 34 prevent tears or stress build-up in the areas where the base of fins 28, 30 join panels 12, 14.

Also as best seen in plan view of FIG. 4, the corners are preferably rounded to reduce the risk of tears in the fabric of the mattress or bedding caused by an unfinished edge of corner guard 10. In the preferred embodiment, when blank 48 is used to form the entire corner guard 10, the thicknesses of all components are substantially constant. It is of course possible to vary the thicknesses or to incorporate thinner areas to promote bending along crease lines.

Aside from the exemplary embodiments illustrated in FIGS. 1–4, the present invention corner guard may have more than one tab per panel, and more than one fin per tab. The fins can extend in any direction to facilitate attachment to the mattress with fasteners or otherwise. The number and location of the fastener openings, if any, can be changed as need. During the assembly process, the angles defined by the panels, tabs, and fins can all be adjusted depending upon the malleability and springback of the base material.

It is of course possible to form the present invention corner guard from a material other than metal. For example, it is possible to form the present invention corner guard through conventional processes using polymers such as polyethylene, polypropylene, acrylonitrile-butadiene-styrene (ABS), and the like.

Other modifications can be made to the present invention without departing from the scope thereof as defined in the following claims. Any specific dimensions, materials of construction, process steps, etc. are given as examples, and substitutes are readily contemplated.

What is claimed is:

1. A corner guard for reinforcing an edge of a mattress comprising:

at least two panels intersecting to define a first angle, the panels together further defining interior areas facing the mattress and exterior areas facing away from the mattress;

a tab extending from one panel to define a second angle, wherein the tab extends toward the interior areas; and a fin extending from the tab wherein the fin extends toward a vertex of the first angle to form a gap along an edge of the fin and one panel.

2. The corner guard according to claim 1, wherein the fin extends toward a vertex of the first angle.

3. The corner guard according to claim 1, wherein an intersection between the fin and the tab defines a third angle.

4. The corner guard according to claim 1, wherein the fin includes a fastener hole.

5. The corner guard according to claim 1, wherein the first angle includes a radius, and the fin includes at least one curved edge.

6. The corner guard according to claim 1, wherein the guard includes a metallic material.

7. The corner guard according to claim 1, wherein the fin, the tab, and the panel define an intersection that includes a circular cut-out.

8. A corner guard for reinforcing an edge of a mattress comprising:

at least two panels intersecting to define a primary angle formed by first and second planes, the panels together further defining interior areas facing the mattress and exterior areas facing away from the mattress;

a tab extending from each panel, wherein the tabs extend toward the interior areas and define third and fourth planes; and a fin extending from each tab, and defining fifth and sixth planes wherein each fin extends toward the other fin and together define a gap spanning radially from a vertex of the primary angle.

9. The corner guard according to claim 8, wherein each fin extends toward a vertex of the primary angle.

10. The corner guard according to claim 8, wherein at least one tab and the associated fin include fastener openings.

11. The corner guard according to claim 8, wherein the primary angle includes a radius and each fin includes at least one curved edge.

12. The corner guard according to claim 8, wherein each tab and fin together extend along substantially a length of one panel.

13. The corner guard according to claim 8, wherein the corner guard includes a metallic material.

14. The corner guard according to claim 8, wherein the panels, tabs, and fins have a substantially constant thickness.

15. A method for providing a reinforcement to an edge of a mattress comprising the steps of:

forming at least two panels intersecting to define a first angle, the panels together further defining interior areas facing the mattress and exterior areas facing away from the mattress;

providing a tab extending from each panel to define second and third angles, wherein each tab extends toward the interior areas;

providing a fin extending from at least one tab wherein the fin extends toward a vertex of the first angle to form a gap along an edge of the fin and one panel; and incorporating the comer guard to the edge of the mattress.

16. The corner guard according to claim 15, wherein at least a portion of the corner guard is plated.

17. The corner guard according to claim 15, wherein at least a portion of the corner guard is polished and sealed.

18. The corner guard according to claim 15, wherein the corner guard includes a polymer material.

* * * * *

UNITED STATES PATENT AND TRADEMARK OFFICE

CERTIFICATE OF CORRECTION

PATENT NO. : 5,878,455

DATED : Mar. 9, 1999

INVENTOR(S) : Ken Patterson

It is certified that error appears in the above-identified patent and that said Letters Patent is hereby corrected as shown below:

Column 3, line 63, change "12", to read --22--.

Signed and Sealed this

Thirteenth Day of July, 1999

*Attest:*

*Attesting Officer*

Q. TODD DICKINSON

*Acting Commissioner of Patents and Trademarks*